US006450536B1

(12) United States Patent
Chen et al.

(10) Patent No.: US 6,450,536 B1
(45) Date of Patent: Sep. 17, 2002

(54) ANTI-FORGERY METHOD AND APPARATUS

(75) Inventors: Zhiqing Chen; Yuanjiu Gong, both of Beijing (CN)

(73) Assignee: Beijing Superenergetic Heavy-Ion S&T Co. Ltd., Beijing (CH)

( * ) Notice: Subject to any disclaimer, the term of this patent is extended or adjusted under 35 U.S.C. 154(b) by 0 days.

(21) Appl. No.: 09/600,843

(22) PCT Filed: Apr. 8, 1998

(86) PCT No.: PCT/CN98/00059

§ 371 (c)(1),
(2), (4) Date: Sep. 25, 2000

(87) PCT Pub. No.: WO99/38145

PCT Pub. Date: Jul. 29, 1999

(30) Foreign Application Priority Data

Jan. 25, 1998 (CN) ..... 98104319 A

(51) Int. Cl.[7] ..... B42D 15/00

(52) U.S. Cl. ..... 283/67; 283/70; 283/72; 235/487

(58) Field of Search ..... 283/72, 74, 78, 283/67, 70, 82, 91, 93, 94, 98, 105, 113, 114, 85; 235/487; 382/135, 108

(56) References Cited

U.S. PATENT DOCUMENTS 4,684,593 A * 8/1987 Wicker ..... 283/93 X
4,710,617 A * 12/1987 Mouchotte ..... 235/487
5,128,779 A * 7/1992 Mallik ..... 283/93 X
5,904,375 A * 5/1999 Brugada ..... 283/85
5,975,583 A * 11/1999 Cubben et al. ..... 283/93

FOREIGN PATENT DOCUMENTS

| | | |
|---|---|---|
| CN | 1080423 | 1/1994 |
| CN | 1116751 | 2/1996 |
| CN | 1123944 | 6/1996 |
| CN | 1159040 | 9/1997 |

OTHER PUBLICATIONS

English Abstract of CN 1159040 Dated Sep. 10, 1997.
English Abstract CN 1116751 Dated Feb. 14, 1996.
English Abstract CN 1080423 Dated Jan. 5, 1994.
English Abstract of CN 1123944 dated Jun. 5, 1996.

* cited by examiner

*Primary Examiner*—Willmon Fridie, Jr.
(74) *Attorney, Agent, or Firm*—Ladas & Parry

(57) ABSTRACT

An anti-forgery method and anti-forgery products using micro-holes or pits are disclosed. The micro-holes or pits are formed in a respective protective pattern on each protected solid article. This random distribution of the micro-holes or pits has a predefined measurable distribution characteristic providing corresponding information that is registered, and used to identify the distribution of micro-holes or pits in the protective pattern on each protected solid article. Because the distribution of the micro-holes or pits formed in accordance with the invention is highly complex and randomly generated, it is unique and cannot be reproduced. Therefore, the effectiveness of the anti-forgery method is highly reliable and, unlike other methods, it is applicable to certificates and bills.

21 Claims, 1 Drawing Sheet

ANTI-FORGERY METHOD AND APPARATUS

BACKGROUND OF THE INVENTION

1. Field of the Invention

The present invention relates to anti-forgery methods, and means for preventing and detecting forgery. More specifically, the invention is directed to using a pattern to prevent and detect forgery.

2. Discussion of Related Art

In the field of anti-forgery technology, printing, heat-sensing, fluorescent, and laser devices are employed, among others. But these devices have two drawbacks: 1) The fabrication method is too simple and, therefore, is likely to be counterfeited. 2) The validation method is too simple, usually relying on human eyesight. These technologies have shown their inherent drawbacks when used in forgery prevention measures for ordinary products, and they are difficult to use on certificates and bills.

For example, laser forgery prevention markers are made through photography and printing technology, which is a fatal drawback. Not only are all markers made by the same equipment in those processes completely the same, but the same markers can also be made by different equipment using those same processes. Therefore, the reliability of their protection and their security can not be guaranteed.

SUMMARY OF THE INVENTION

The present invention provides anti-forgery method and means. Anti-forgery products made in accordance with the present invention are not easily counterfeited.

After a long period of studying the problem, the inventor found that if holes or pits are made on a solid material and the size of these holes or pits is small enough, human eyes will not identify the individual micro-holes or pits. Thus, only a macro-image formed by the pattern of the micro-holes or pits will be seen within such a pattern. However, the distribution of the micro-holes or pits within such a pattern contains unique information. Specifically, the information present in the distribution of the micro-holes or pits within such a pattern is detectably different for different distributions of the holes.

The distribution of the micro-holes or pits within the pattern is out of control or difficult to control during fabrication of micro-holes or pits produced in accordance with the present invention. Therefore the distribution is unique and can not be reproduced, that is, if the distribution produced when the pattern is produced is uncontrollable, or difficult to control, there will be no two anti-forgery markers made that are the same. More important, the patterns made in accordance with the present invention can not be reproduced or copied by other technologies, such as photography or printing.

Furthermore, this anti-forgery means and method is one that can be applied to the field of anti-forgery protection of certificates and bills. And, when it is, high reliability and security can be guaranteed.

BRIEF DESCRIPTION OF THE DRAWINGS

The nature and advantages of the present invention will be more clearly understood when the detailed description of embodiments provided below is considered in combination with the accompanying drawings, wherein.

DETAILED DESCRIPTION OF THE PREFERRED EMBODIMENTS

In accordance with a preferred embodiment of the present invention, a serial accelerator accelerates ions of sulfur to form a ion beam of sulfur having an energy of 120 Mev, and an intensity of 40 $\mu$mA. The beam's radiation is directed onto a 12 mm-thick polycarbonate film through a pattern mask for 0.8 second. The film is then put into a 25% (by weight) NaOH solution to be etched for 2 hours. After etching, the film is washed with water and dried at a temperature of 40° C.

This process forms a high-contrast, milk-white pattern on a transparent film. In the pattern area, there are a lot of micro-holes. Their distribution is random, their diameters are about 1 $\mu$m, and their density is about $10^5/cm^2$. Micro-hole diameters within the range of 0.1–100 $\mu$m and densities within the range of $10^3/cm^2$–$10^6/cm^2$ can be produced.

Figure 1:
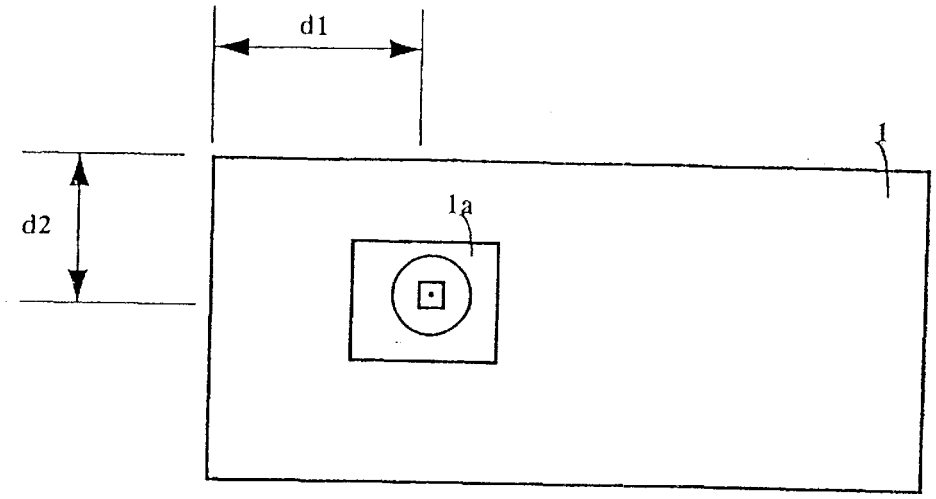
FIG. 1 is a plan view of a personal identification card having an anti-forgery pattern in accordance with the present invention.
Figure 2:
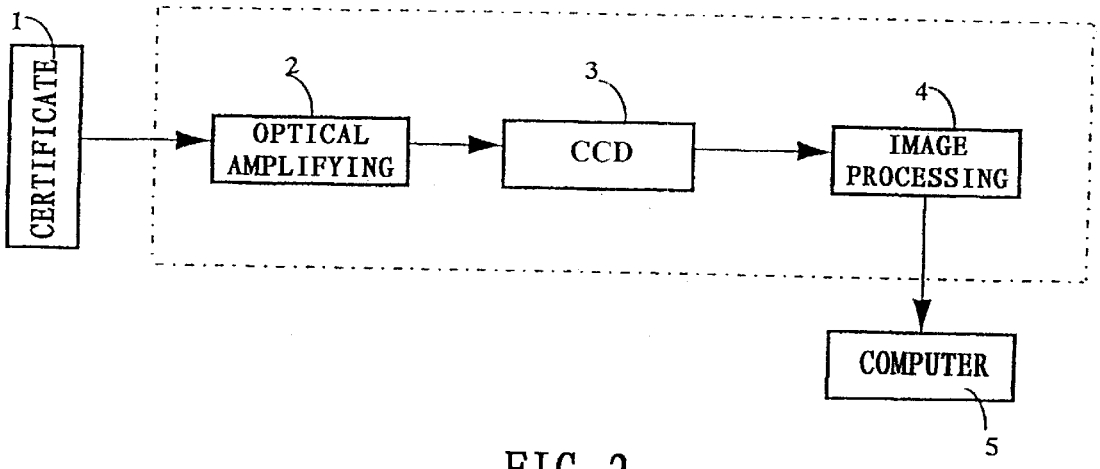
FIG. 2 is a block drawing of a validation system employing a method in accordance with the present invention.

Alternatively, if the beam of radiation is directed to the film directly, without using any pattern masks, the film will turn completely milk-white and a large number of micro-holes will be formed throughout the film. The distribution of these micro-holes will also be random. Preferably the image of the pattern thus formed has a round shape, and has a diameter of 1 cm. cm. As shown in FIG. 1, the piece of the film that has the milk-white pattern, $d_1=d_2=20$ mm, can be adhered to a corner of a personal identification card 1.

In accordance with the present invention, the authentication apparatus comprises a detecting instrument and a computer that serve a double function, both registering and validating the anti-forgery devices. During the registration phase, a 1 mm by 1 mm portion of the center of the round pattern is magnified by an optical magnifier to 8 times its original size and imaged on the surface of the CCD 3. CCD 3 produces electrical digital image signals corresponding to that portion of the pattern. The digital image signals produced by the CCD 3 are supplied to an image processing unit 4. The digital image signals supplied to the image processing unit 4 contain distribution information corresponding uniquely to the distribution of the micro-holes in that portion of that particular round pattern that is output by the image processing unit as distribution data, in any suitable manner that is well-known in the art.

The distribution data obtained by the image processing unit 4 from the processed digital image signals is transmitted by the image processing unit 4 to a computer 5. The distribution data obtained from the processed digital image signals contains distribution information corresponding uniquely to the distribution of the micro-holes. The computer performs compression processing, compressing the distribution data, and stores that compressed distribution data as an entry in registration information stored for that particular personal identification card.

The initial steps of the validation process are the same as the initial steps of registration. However, the distribution information obtained from the card being validated is then compared with the stored compressed distribution data for that card. If the distribution information obtained from the card matches or substantially matches the stored compressed distribution data, then the personal identification card or certificate is true. Otherwise, the personal identification card or certificate is false—it has been counterfeited. When registration and validation facilities are located in two different places, validation can be carried out by using network connections between the facilities to obtain the stored compressed distribution data.

Although the invention has been described with reference to a particular preferred embodiment, it will be apparent to one skilled in the art that variations and modification are possible within the spirit and scope of the invention. For example the distribution information may correspond to a distribution of micro-pits on a surface being registered or verified, or the beam of energy may be produced by a reactor. The scope of the invention is defined by the claims provided below.

What is claimed is:

1. An anti-forgery method for determining the identity of sample articles with respective protected articles, said method authenticating a given sample article as being a given protected article, said method comprising the steps of:

forming a protective pattern of tiny ablations on the given protected article, said tiny ablations in said protective pattern having a substantially random distribution;

detecting characteristic distribution information corresponding to a predefined characteristic of said distribution of tiny ablations formed on the given protected article, said characteristic distribution information corresponding uniquely to said characteristic distribution information detected for said predefined characteristic of said protective pattern formed on the given protected article;

storing registration information identifying the given protected article, said registration including said distribution information corresponding to said distribution of said tiny ablations in said protective pattern formed on the protected article;

detecting sample distribution information corresponding to a distribution of tiny ablations detected within a protective pattern on the given sample article; and comparing the distribution information detected in the protective pattern on the given sample article with the distribution information in said registration information, whereby the identity of the given sample article with the given protected article is determined.

2. The method of claim 1 wherein the size of the tiny ablations is within the range of 0.1–100 $\mu$m.

3. The method of claim 1 wherein the average density of the tiny ablations is in the range of $10^3/cm^2$–$10^6/cm^2$.

4. The method of claim 1 wherein said tiny ablations are formed by a beam of energy.

5. An anti-forgery product for determining the identity of a sample article with a respective protected article, said product authenticating the given sample as being the given protected article, said product comprising:

a given protected article having a protective pattern;

tiny ablations formed in the protective pattern on said protected article, said tiny ablations having a substantially random distribution, said tiny ablations being adapted to provide characteristic distribution information corresponding to a predefined characteristic of said substantially random distribution when said characteristic distribution information is detected in a predefined manner from said tiny ablations, said characteristic distribution information detected in the protective pattern in said predefined manner uniquely distinguishing said given protected article from other protected articles having respective protective patterns.

6. The product of claim 5 wherein the size of the tiny ablations is within the range of 0.1–100 $\mu$m.

7. The product of claim 5 wherein the average density of the tiny ablations is within the range of $10^3/cm^2$–$10^6/cm^2$.

8. The product of claim 5 wherein said tiny ablations are formed by a beam of energy.

9. The method of claim 1 wherein said tiny ablations are produced by an accelerator.

10. The method of claim 1 wherein said tiny ablations are produced by a reactor.

11. The product of claim 5 wherein said tiny ablations are micro-holes.

12. The product of claim 5 wherein said tiny ablations are pits.

13. The method of claim 1 wherein said tiny ablations are micro-holes.

14. The method of claim 1 wherein said tiny ablations are pits.

15. An anti-forgery method for determining the identity of a given sample article having a protective pattern with respect to a given protected article having a respective protective pattern, said method providing authentication of sample article as being said given protected article or not being said given protected article, said method comprising the steps of:

detecting sample distribution information corresponding to a distribution of tiny ablations detected within the protective pattern on the sample article; and comparing the sample distribution information detected in the protective pattern on the given sample article with corresponding distribution information detected in the protective pattern on the given protected article, whereby the identity of the given sample article with the given protected article is determined.

16. An anti-forgery method for preparing protected articles, said method providing means for authenticating a given sample article as being a given on of the protected articles, said method comprising the steps of:

forming a protective pattern of tiny ablations on the given protected article, said tiny ablations in said protective pattern having a substantially random distribution;

detecting characteristic distribution information corresponding to a predefined characteristic of said distribution of tiny ablations formed on the given protected article, said characteristic distribution information corresponding uniquely to said characteristic distribution information detected for said predefined characteristic of said protective pattern formed on the given protected article;

storing registration information identifying the given protected article, said registration including said distribution information corresponding to said distribution of said tiny ablations in said protective pattern formed on the protected article.

17. A protected article prepared in accordance with the method of claim 16.

18. The anti-forgery product of claim 5 further comprising:

protective distribution information corresponding to said distribution of tiny ablations in said protective pattern on the protected article, said protective distribution information being distribution information detected from said protective pattern of tiny ablations in a given way, said protective distribution information being different from stored protective distribution information detected in said given way from a similar protective patterns of tiny ablations on any second article, said stored protective distribution information being included in stored registration information, said stored registration information identifying said second article.

19. The product of claim 17 wherein said protective patterns have a given predetermined shape.

20. The method of claim 4 wherein said beam of energy passes through a pattern mask.

21. An anti-forgery product for determining the identity of a sample article with a respective protected article, said product authenticating the given sample as being the given protected article, said product comprising:

a given protected article having a protective pattern;

tiny ablations formed in the protective pattern on said protected article, said tiny ablations having a substantially random distribution, said tiny ablations being adapted to provide characteristic distribution information corresponding to a predefined characteristic of said substantially random distribution when said characteristic distribution information is detected in a predefined manner from said tiny ablations, said characteristic distribution information detected in the protective pattern in said predefined manner uniquely distinguishing said given protected article from other protected articles having respective protective patterns.

* * * * *

UNITED STATES PATENT AND TRADEMARK OFFICE

CERTIFICATE OF CORRECTION

PATENT NO. : 6,450,536 B1 
DATED : September 17, 2002
INVENTOR(S) : Zhiqing Chen et al.

It is certified that error appears in the above-identified patent and that said Letters Patent is hereby corrected as shown below:

Column 2,
Line 10, "mm" should read -- $\mu$m --.

Signed and Sealed this

Twenty-ninth Day of April, 2003

JAMES E. ROGAN
*Director of the United States Patent and Trademark Office*